US010104731B2

(12) United States Patent
Hu et al.

(10) Patent No.: US 10,104,731 B2
(45) Date of Patent: Oct. 16, 2018

(54) COMBINATION DIMMABLE DRIVER

(71) Applicant: ABL IP Holding LLC, Atlanta, GA (US)

(72) Inventors: Feng-Kang Hu, Palos Verdes, CA (US); Hangyang Wang, Da Li Ji Chun (CN); Feng Chen, Hoffman Estates, IL (US); Towfiq Chowdhury, Lake Forest, IL (US); Charles J. Spencer, Wilmette, IL (US)

(73) Assignee: ABL IP Holding LLC, Atlanta, GA (US)

( * ) Notice: Subject to any disclaimer, the term of this patent is extended or adjusted under 35 U.S.C. 154(b) by 223 days.

(21) Appl. No.: 14/962,968

(22) Filed: Dec. 8, 2015

(65) Prior Publication Data

US 2017/0164440 A1 Jun. 8, 2017

Related U.S. Application Data

(60) Provisional application No. 62/264,310, filed on Dec. 7, 2015.

(51) Int. Cl.
*H05B 33/08* (2006.01)

(52) U.S. Cl.
CPC ..... *H05B 33/0845* (2013.01); *H05B 33/0809* (2013.01); *H05B 33/0821* (2013.01)

(58) Field of Classification Search
CPC ..... H05B 33/08; H05B 33/0809; H05B 33/0821; H05B 33/0842; H05B 33/0845; H05B 33/0881; H05B 37/02
(Continued)

(56) References Cited

U.S. PATENT DOCUMENTS 6,356,027 B1 3/2002 Zhang et al.
8,111,017 B2 2/2012 Lin et al.
(Continued)

FOREIGN PATENT DOCUMENTS

CA 2740629 A1 6/2010
CA 2907633 A1 10/2014
WO 2014084982 A2 6/2014

OTHER PUBLICATIONS

Office Action for Canadian Application No. CA 2,950,838, dated Oct. 23, 2017, (3 pages).

*Primary Examiner* — Jimmy Vu
(74) *Attorney, Agent, or Firm* — Kilpatrick Townsend & Stockton LLP

(57) ABSTRACT

A dimmable driver for an LED light fixture allows multiple types of dimmers to be used with the light fixture. The dimmable driver may be disconnected from one type of dimmer and subsequently connected to another type of dimmer without having to replace or otherwise adjust the driver for each dimmer. Multiple types of dimmers may be connected to dimmable driver at the same time and the dimmable driver may use dimming signals from one or several of these dimmers. In some embodiments, the dimmable driver is configured to accommodate a step dimmer, a 0-10 V dimmer, and a phase-cut dimmer. Other dimmers and dimming protocols may be accommodated by the dimmable driver in alternative embodiments. Such an arrangement maximizes flexibility for lighting specifiers, contractors, and distributors while minimizing potential errors, costs, delays, and obsolete inventory.

21 Claims, 9 Drawing Sheets

(58) Field of Classification Search
USPC .... 315/151–158, 185 R, 224–226, 291, 307, 315/308, 312
See application file for complete search history.

(56) References Cited

U.S. PATENT DOCUMENTS

| | | | | |
|---|---|---|---|---|
| 8,319,452 | B1 * | 11/2012 | Hamel | H05B 37/029 315/291 |
| 8,350,493 | B2 | 1/2013 | Coley | |
| 8,492,984 | B2 | 7/2013 | Deurenberg et al. | |
| 9,655,179 | B2 * | 5/2017 | Brandt | H05B 33/0815 |
| 2009/0184662 | A1 * | 7/2009 | Given | H05B 33/0815 315/294 |
| 2010/0102747 | A1 | 4/2010 | Ilyes et al. | |

* cited by examiner

| Line 1 | Line 2 | LEDs |
|---|---|---|
| 1 | 1 | 100% |
| 1 | 0 | 10-35% |
| 0 | 1 | 45-65% |
| 0 | 0 | 0% |
200
FIG. 2A
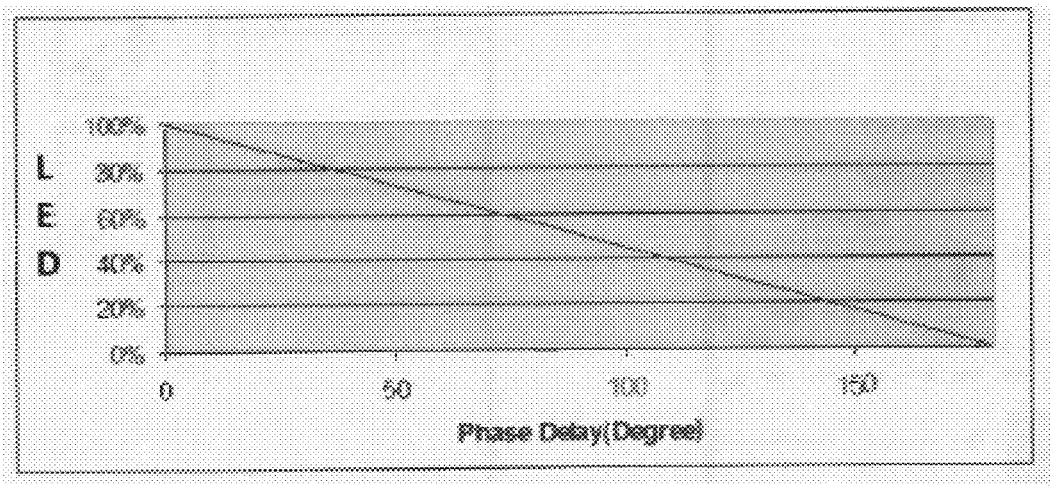
FIG. 2B
200'
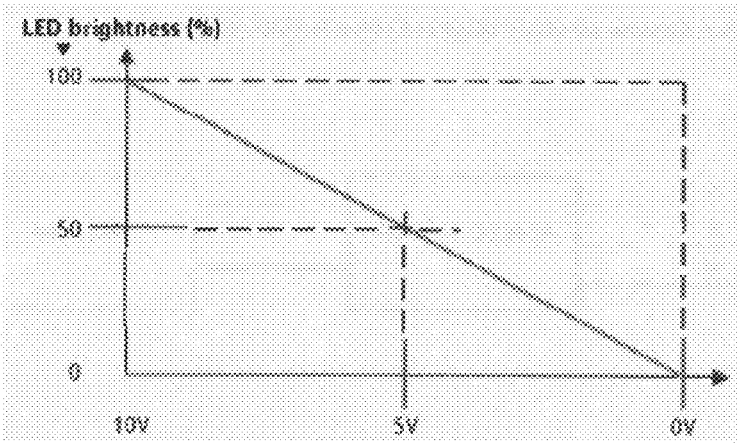
FIG. 2C
200"

COMBINATION DIMMABLE DRIVER

CROSS-REFERENCE TO RELATED APPLICATIONS

This application for patent claims the benefit of priority to, and incorporates herein by reference, U.S. Provisional Application Ser. No. 62/264,310, entitled "Combination Dimmable Driver," filed Dec. 7, 2015.

FIELD OF THE INVENTION

The disclosed embodiments relate generally to methods and systems for dimming solid-state lighting devices, such as light emitting diodes (LEDs), and more particularly to a method and system for dimming LEDs using a single dimmable driver that can accept multiple types of dimmers.

BACKGROUND OF THE INVENTION

LEDs have the potential to revolutionize the efficiency, appearance, and quality of lighting. See http://www.energystar.gov/index.cfm?c=lighting.pr_what_are. The United States Department of Energy estimates that rapid adoption of LED lighting in the U.S. could provide savings of roughly $265 billion, avoid 40 new power plants, and reduce lighting electricity demand by 33% by 2027. Thus, the market for LED lighting is expected to grow significantly in the coming years compared to traditional, non-LED based lighting.

As the adoption of LED technology has evolved, lighting controls have become an integral part of the lighting selection process for energy savings and visual comfort. With this increased reliance on controls have come new challenges for lighting designers, specifiers, contractors, and distributors. Consider, for example, a typical lighting fixture that includes a lamp (LEDs) driven by a driver (AC-to-DC converter). The driver is usually configured to operate either with wall switches that provide a step dimming function, a 0-10 V dimmer that provides a more smooth dimming function, or the ubiquitous phase-cut dimmer commonly used with conventional incandescent lights. Existing step dimming drivers, however, are not compatible (i.e., do not operate properly) with 0-10 V dimmers or phase-cut dimmers. Nor are existing 0-10 V dimming drivers compatible with wall switches or phase-cut dimmers, or existing phase-cut dimming drivers with wall switches and 0-10 V dimmers.

The above incompatibility among the different types of dimmable drivers forces lighting specifiers to make sure that the fixtures they select for aesthetics and performance purposes are also compatible with the dimming controls they plan to use in a given room or space. Lighting contractors must also make sure they order and receive fixtures that are compatible with the dimming controls being used for a given project. But as the dimming control systems are not always specified beforehand by the lighting specifiers, or because the specifications sometimes change during a project, the contractors have to keep multiple types of fixtures on hand. Lighting distributors must similarly make sure they carry the correct mix of fixtures that are compatible with the dimming control systems needed by the specifiers and contractors in order to meet compressed deadlines and increased customer expectations. At the same time, the distributors must minimize inventory to avoid being stuck with obsolete products that are based on old technology while LED technology continues to advance and LED fixtures continue to progress.

Thus, a need exists for an improved lighting fixture that is compatible with multiple types of dimmers, and particularly a dimmable driver for such lighting fixture that can operate with multiple dimming protocols.

SUMMARY OF THE DISCLOSED EMBODIMENTS

The disclosed embodiments are directed to a method and system for dimming LEDs in a light fixture using a dimmable driver that can operate with multiple dimming protocols. The method and system is able to achieve expanded compatibility by combining several of the most widely used dimming protocols into one dimmable driver. This combining allows the dimmable driver to be disconnected from one type of dimmer and subsequently connected to another type of dimmer without having to replace or otherwise adjust the driver for each dimmer. Such a combination dimmable driver may be then installed in any LED or other solid-state lighting fixture to allow the lighting fixture to accommodate multiple types of dimmers. The resulting lighting fixture may thereafter be used in any number of lighting applications with high confidence that there will be no compatibility issues with the dimmer. This maximizes flexibility for lighting specifiers, contractors, and distributors while minimizing potential errors, costs, delays, and obsolete inventory.

In some embodiments, the combination dimmable driver may comprise an AC/DC power converter, a dimming controller, and a dimming signal converter. The AC/DC power converter and the dimming controller may be conventional components that are commonly employed in LED lighting applications. These components operate in their usual manner to provide power to the LEDs and to control the level of dimming of the LEDs, respectively, based on a dimming signal from a dimmer.

In accordance with the disclosed embodiments, the dimming signal converter operates to expand the compatibility of the dimming controller by allowing a dimming signal or dimming signals from several different types of dimmers to be used. The dimming signal converter converts the dimming signal(s) from the dimmer(s), whichever type is being used, into a common dimming level indicator and provides the dimming level indicator to the dimming controller. The dimming controller receives the dimming level indicator and uses it to control the level of dimming of the LEDs in the usual manner. In a typical scenario, only one type of dimmer is connected at a time to the combination dimmable driver. In other scenarios, multiple types of dimmers may be connected at the same time to the combination dimmable driver. In the latter case, the combination dimmable driver may look for a preset default type of dimmer and use the dimming signal from that dimmer before looking for dimming signals from other types of dimmers, or the combination dimmable driver may use dimming signals from all or several of the dimmers to generate the dimming signal indicator.

In some embodiments, the types of dimmers from which the dimming signal converter can receive and process dimming signals include a step dimmer, a 0-10 V dimmer, and a phase-cut dimmer. In one or more of these embodiments, the dimming signal converter may first look for a dimming signal from the 0-10 V dimmer and, if present, generate a dimming level indicator based on a dimming signal from the 0-10 V dimmer and provide the indicator to the dimming controller.

If the 0-10 V dimmer is not present, then in one or more of these embodiments the dimming signal converter may look for dimming signals from the phase-cut dimmer and the step dimmer, or vice versa. These latter types of dimmers typically provide two dimming signals, a first and a second dimming signal, that may be used as first and second logic signals by the dimming signal converter. The dimming signal converter may then generate an appropriate dimming level indicator based on these two logic signals. With a step dimmer, for example, if both first and a second dimming signals are logically asserted, then the dimming signal converter generates a minimum dimming level indicator (i.e., little or no dimming). If both dimming signals are logically unasserted, then the dimming signal converter generates a maximum dimming level indicator. If only one of the dimming signals is logically asserted, then the dimming signal converter generates a dimming level indicator that is between the minimum and maximum.

With a phase-cut dimmer, both the first and second dimming signals typically remain logically asserted at all times so the dimming level indicator generated by the dimming signal converter remains fixed at a minimum level. Dimming is then adjusted (i.e., increased) by using the phase delays imposed by the phase-cut dimmer on the voltage input from the AC/DC power converter. This arrangement has an added advantage in that there is no need for the dimming signal converter to determine whether the dimming signals came from the phase-cut dimmer or the step dimmer.

In some embodiments, the dimming signal converter may use dimming signals from all three types of dimmers at the same time. In these embodiments, the dimming signal converter may generate the dimming level indicator based on all three dimming signals using a predefined priority that specifies the order in which the dimming signals are applied. For example, the dimming signal converter may apply the dimming signal from the phase-cut dimmer first, then the step dimmer, and then the 0-10 V dimmer, or vice versa, or some other sequence, to generate the dimming level indicator.

Alternatively, the dimming signal converter may generate the dimming level indicator based on any two dimming signals using a predefined priority, or the dimming signal converter may generate the dimming level indicator based on only one dimming signal using a predefined priority.

In still other embodiments, the dimming signal converter may instead generate a dimming level indicator reflecting predefined defaults or programmed dimming levels when dimming signals from multiple types of dimmers are received at the same time. In these embodiments, one or more tables may be used to specify to the dimming signal converter which dimming level indicators should be generated when dimming signals from multiple types of dimmers are received at the same time.

In some embodiments, a comparator may be provided in the combination dimmable driver. The comparator may compare the two dimming signals from the phase-cut dimmer or the step dimmer to a reference voltage and provide either asserted or unasserted first and second logic dimming signals, as may be appropriate, to the dimming signal converter.

In general, in one aspect, the disclosed embodiments are directed to a combination dimmable driver for a light fixture. The combination dimmable driver comprises, among other things, an AC/DC power converter connected to the light fixture and configured to provide power to a plurality of LEDs in the light fixture, and a dimming controller connected to the AC/DC power converter, the dimming controller configured to control a level of dimming for the plurality of LEDs in the light fixture. The combination dimmable driver further comprises a dimming signal converter connected to the dimming controller and configured to provide a dimming level indicator to the dimming controller, the dimming controller controlling the level of dimming for the plurality of LEDs based on the dimming level indicator. The dimming signal converter is further configured to receive dimming signals from multiple types of dimmers and generate the dimming level indicator based on a dimming signal received from one of the multiple types of dimmers.

In general, in another aspect, the disclosed embodiments are directed to a method of dimming a plurality of LEDs in a light fixture. The method comprises, among other things, receiving a dimming signal from at least one of multiple types of dimmers, generating a dimming level indicator based on the dimming signal from said at least one of the multiple types of dimmers, and controlling a level of dimming for the plurality of LEDs in the light fixture based on the dimming level indicator.

In general, in still another aspect, the disclosed embodiments are directed to a light fixture. The light fixture comprises, among other things, a plurality of LEDs and a dimmable driver connected to the plurality of LEDs. The dimmable driver is compatible with three or more types of dimmers and configured to control dimming of the plurality of LEDs based on a dimming signal from at least one of said types of dimmers.

BRIEF DESCRIPTION OF THE DRAWINGS

The foregoing and other advantages of the disclosed embodiments will become apparent upon reading the following detailed description and upon reference to the drawings, wherein:

FIGS. 2A-2C illustrate exemplary dimming profiles of the combination dimmable driver according to some implementations of the disclosed embodiments;

DETAILED DESCRIPTION OF THE DISCLOSED EMBODIMENTS

As an initial matter, it will be appreciated that the development of an actual, real commercial application incorporating aspects of the disclosed embodiments will require many implementation specific decisions to achieve the developer's ultimate goal for the commercial embodiment. Such implementation specific decisions may include, and likely are not limited to, compliance with system related, business related, government related and other constraints, which may vary by specific implementation, location and from time to time. While a developer's efforts might be complex and time consuming in an absolute sense, such efforts would nevertheless be a routine undertaking for those of skill in this art having the benefit of this disclosure.

It should also be understood that the embodiments disclosed and taught herein are susceptible to numerous and various modifications and alternative forms. Thus, the use of a singular term, such as, but not limited to, "a" and the like, is not intended as limiting of the number of items. Similarly, any relational terms, such as, but not limited to, "top," "bottom," "left," "right," "upper," "lower," "down," "up," "side," and the like, used in the written description are for clarity in specific reference to the drawings and are not intended to limit the scope of the invention.

Figure 1A:
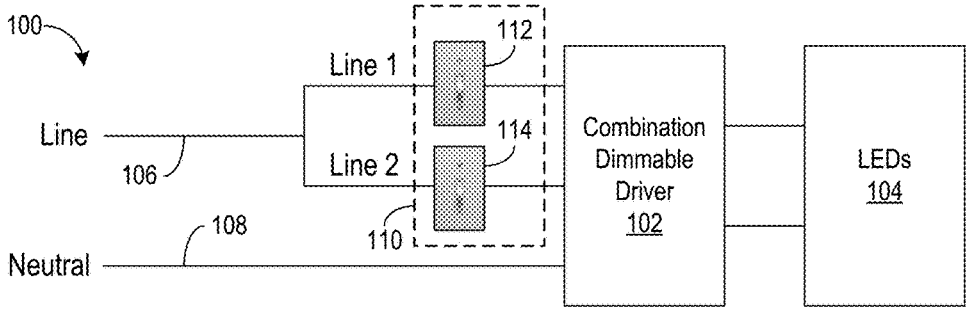
FIGS. 1A-1C illustrate exemplary lighting applications for a combination dimmable driver according to some implementations of the disclosed embodiments.
Figure 1B:
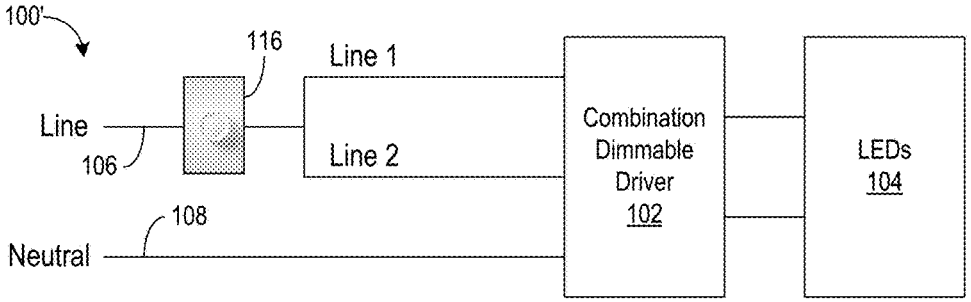
Figure 1C:
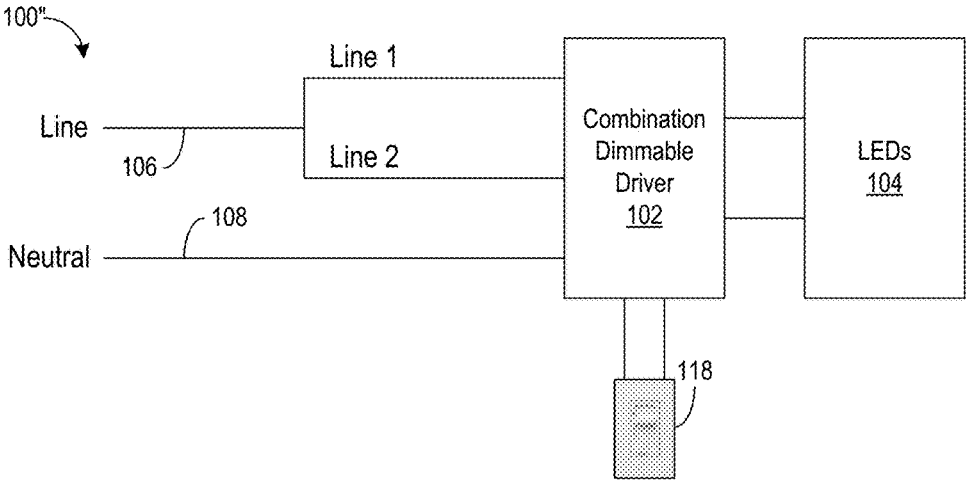

Referring now to FIGS. 1A-1C, exemplary lighting applications 100, 100', and 100", respectively, are depicted in which a single driver 102 may be used with multiple different types of dimmers to control dimming for an array of LEDs 104. In general, the driver 102 operates to convert AC current from a line conductor 106 to DC current using known AC-to-DC conversion techniques. The driver 102 may then provide the DC current to the LEDs 104 to turn on the LEDs. The line conductor 106 is typically connected to an AC mains (not expressly shown), while a neutral conductor 108 provides a return path for the current flowing through the LEDs 104. In accordance with the disclosed embodiments, the driver 102 may be a combination dimmable driver that incorporates several widely-used dimming protocols, thus allowing it to be compatible with multiple different types of dimmers.

In the lighting application 100 of FIG. 1A, for example, the combination dimmable driver 102 may be connected to and is compatible with a step dimmer 110. The step dimmer 110 may be composed of two switches 112, 114, each of which may be independently turned on and off to control dimming of the LEDs 104. To accommodate the two switches 112, 114, the line conductor may be split into two lines, Line 1 and Line 2, one for each switch 112, 114, respectively. Each switch 112, 114 in turn provides an independent dimming signal to the combination dimmable driver 102.

In the lighting application 100' of FIG. 1B, the same combination dimmable driver 102 may be connected to and is compatible with a phase-cut dimmer 116. The phase-cut dimmer 116, which may be a forward phase-cut dimmer or a reverse phase-cut dimmer, uses essentially the same wiring as the step dimmer 116, except that the phase-cut dimmer 116 is positioned before the line conductor becomes Line 1 and Line 2. This means the phase-cut dimmer 116 controls both Line 1 and Line 2 together, so neither line is independent of the other relative to the combination dimmable driver 102.

In the lighting application 100" of FIG. 1C, the same combination dimmable driver 102 may again be connected to and is compatible with a 0-10 V dimmer 118. The 0-10 V dimmer 118 does not use the same wiring as the step dimmer 110 and the phase-cut dimmer 116, but instead has its own separate connections to the combination dimmable driver 102, typically through an isolation transformer, as shown later herein.

FIGS. 2A-2C illustrate exemplary dimming profiles implemented by the combination dimmable driver for the step dimmer, the phase-cut dimmer, and the 0-10 V dimmer, respectively, according to some embodiments. In general, the individual dimming profile implemented by the combination dimmable driver for each type of dimmer is substantially the same as the dimming profile implemented by conventional dimmable drivers for that type of dimmer. However, whereas a conventional dimmable driver is designed to implement only a single dimming profile corresponding to one of the dimmers, the combination dimmable driver disclosed herein can implement multiple dimming profiles corresponding to all of the dimmers.

As can be seen in FIG. 2A, when the step dimmer 110 is used, the combination dimmable driver 102 implements a dimming profile according to table 200. Specifically, when both of the switches 112, 114 of the step dimmer 110 are on, meaning current flows through both Line 1 and Line 2, the combination dimmable driver 102 provides minimum or no dimming of the LEDs 104. On the other hand, if both switches 112, 114 are off, meaning current flows through neither Line 1 nor Line 2, the combination dimmable driver 102 provides maximum dimming of the LEDs 104. If the first switch 112 is on and the second switch 114 is off, then current flows through Line 1 only, and the combination dimmable driver 102 dims the LEDs 104 about 10-35%. If the first switch 112 is off and the second switch 114 is on, then current flows through Line 2 only, and the combination dimmable driver 102 dims the LEDs 104 about 45-65%.

FIG. 2B shows a graph 200' depicting the dimming profile implemented by the combination dimmable driver 102 when the phase-cut dimmer 116 is used. As the graph 200' shows, when the phase-cut dimmer 116 produces a phase-cut that results in a small phase delay (e.g., about 0 degrees), the combination dimmable driver 102 provides minimum or no dimming of the LEDs 104 accordingly. Conversely, when the phase-cut dimmer 116 produces a phase-cut that results in a large phase delay (e.g., about 180 degrees), the combination dimmable driver 102 provides maximum dimming of the LEDs 104 accordingly.

In a similar manner, FIG. 2C shows a graph 200" illustrating the dimming profile implemented by the combination dimmable driver 102 when the 0-10 V dimmer 118 is used. As the graph 200" displays, when the 0-10 V dimmer 118 produces a large dimming voltage (e.g., about 10 V), the combination dimmable driver 102 provides minimum or no dimming of the LEDs 104 accordingly. But when the 0-10 V dimmer 118 produces a small dimming voltage (e.g., about 0 V), the combination dimmable driver 102 provides maximum dimming of the LEDs 104 accordingly.

Figure 3:
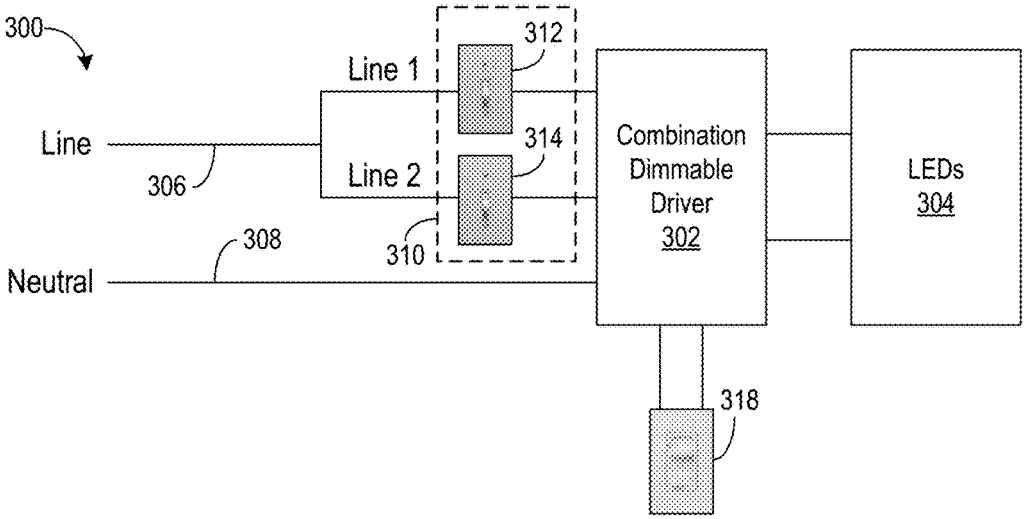
FIG. 3 illustrates an exemplary combination dimmable driver connected to a step dimmer and a 0-10 V dimmer at the same time according to some implementations of the disclosed embodiments.

FIG. 3 illustrates another exemplary lighting application 300 in which a single combination dimmable driver 302 may be used with multiple different types of dimmers to control dimming for an array of LEDs 304. Like the previous examples, the combination dimmable driver 302 operates to convert AC current from a line conductor 306 to DC current that may be used to drive the LEDs 304 in a known manner. The line conductor is again connected to an AC mains (not expressly shown), while a neutral conductor 308 provides a return path for the current flowing through the LEDs 304.

In the lighting application 300 of FIG. 3, the combination dimmable driver 302 may be connected to both a step dimmer 310 and a 0-10 V dimmer 318 at the same time. The step dimmer 310 may again be composed of two switches 312, 314, with the line conductor 306 split into two lines, Line 1 and Line 2, respectively, one for each switch 312, 314. The 0-10 V dimmer 318 has its own separate connection to the combination dimmable driver 302 and may again be a conventional 0-10 V dimmer known to those having ordinary skill in the art.

In accordance with the disclosed embodiments, the combination dimmable driver 302 may look for the presence of the 0-10 V dimmer 318 and, if detected, may default to using the dimming signal from the 0-10 V dimmer 318 to control dimming. Otherwise, the combination dimmable driver 302 looks for any dimming signals that may be present on Line 1 and Line 2 and uses these dimming signals, if detected, to control dimming. In this particular example, any dimming signals that may be present on Line 1 and/or Line 2 are provided by the step dimmer 310.

Figure 4:
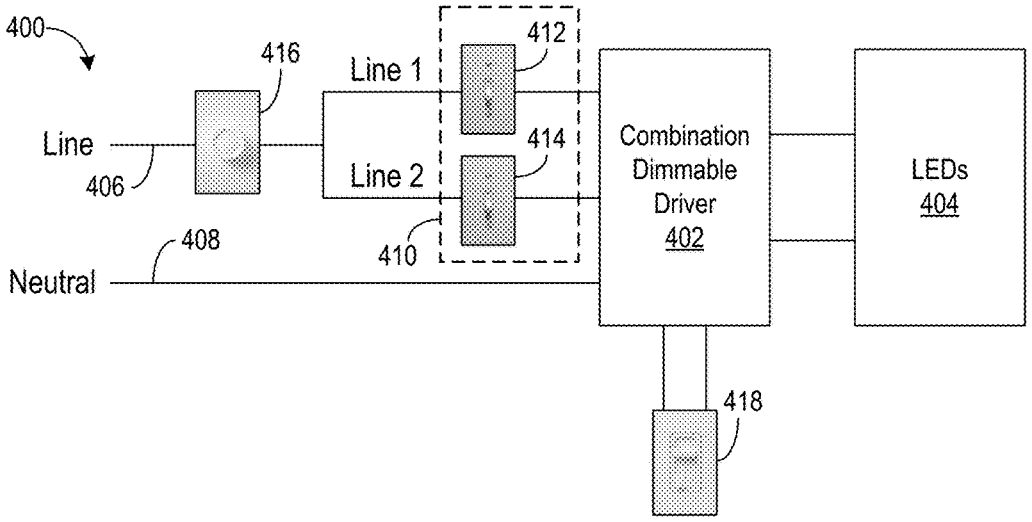
FIG. 4 illustrates the exemplary combination dimmable driver connected to a step dimmer, a phase-cut dimmer, and a 0-10 V dimmer at the same time according to some implementations of the disclosed embodiments.

FIG. 4 illustrates yet another exemplary lighting application 400 in which a single combination dimmable driver 402 may be used with multiple different types of dimmers to control dimming for an array of LEDs 404. In the lighting application 400 shown here, the combination dimmable driver 402 may be connected to both a step dimmer 410, a phase-cut dimmer 416, as well as a 0-10 V dimmer 418 at the same time. The step dimmer 410 may once more be composed of two switches 412, 414, and the line conductor 406 may be split into two lines, Line 1 and Line 2, respectively. The phase-cut dimmer 416 uses essentially the same wiring as the step dimmer 416, but is positioned before the point where the line conductor 406 splits into Line 1 and Line 2. The 0-10 V dimmer 418 again has its own connection to the combination dimmable driver 402.

In accordance with the disclosed embodiments, the combination dimmable driver 402 may, like before, look for the presence of the 0-10 V dimmer 418 and, if detected, may default to using the dimming signal from the 0-10 V dimmer 418. Otherwise, the combination dimmable driver 402 again looks for any dimming signals that may be present on Line 1 and Line 2 and uses these dimming signals, if detected. In this example, any dimming signal that may be present on Line 1 and/or Line 2 may be provided by either the step dimmer 410 or the phase-cut dimmer 416.

Figure 5:
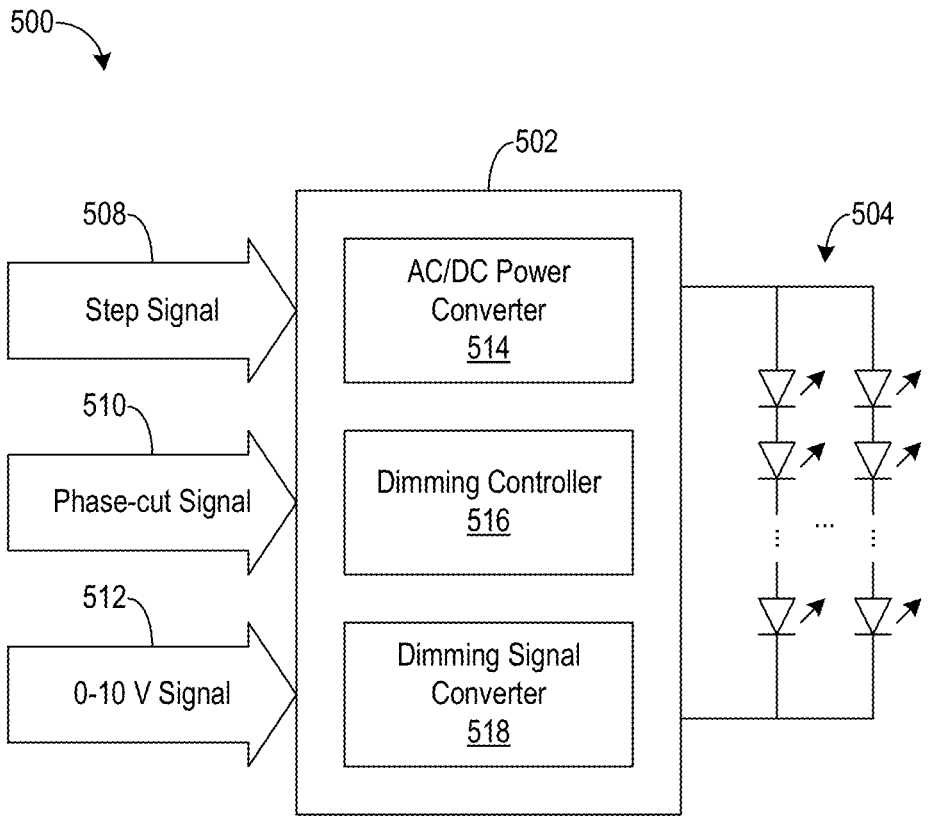
FIG. 5 illustrates an exemplary functional block diagram for the combination dimmable driver according to some implementations of the disclosed embodiments.

FIG. 5 illustrates a functional block diagram for an exemplary combination dimmable driver 502 that is capable of controlling dimming for an array of LEDs 504 according to the embodiments disclosed herein. In particular, the combination dimmable driver 502 is capable of controlling dimming for the LEDs 504 based on several different types of dimming signals, such as a step dimming signal 508, a phase-cut dimming signal 510, and a 0-10 V dimming signal 512. As can be seen, the combination dimmable driver 502 is composed of a number of functional components, including an AC/DC power converter 514, a dimming controller 516, and a dimming signal converter 518.

It should also be noted that although FIG. 5 (and other figures herein) depict a number of discrete functional components, those having ordinary skill in the art will understand that any one of these components may be divided into two or more constituent components and/or two or more of these components may be combined into a single component as needed without departing from the scope of the disclosed embodiments. Each of the components 514-518 are explained further below.

In general, the AC/DC power converter 514 operates in a known manner to convert AC current to DC current that may then be used to drive the LEDs 504. The dimming controller 516 similarly operates in a known manner to control dimming of the LEDs 504, typically by switching on and off the converted DC current at a particular frequency based on a desired level of dimming. The desired level of dimming and hence the specific switching frequency used by the dimming controller 516 is derived from a dimming level indicator generated by the dimming signal converter 518.

In accordance with the disclosed embodiments, the dimming level indicator (shown in FIG. 6) generated by the dimming signal converter 518 may be based on either the step dimming signal 508, the phase-cut dimming signal 510, and/or the 0-10 V dimming signal 512. That is, the dimming signal converter 518 is compatible with and capable of receiving any one of the above dimming signals 508-512 and converting one or more of the signals into a corresponding dimming level indicator that may then be used by the dimming controller 516 to control dimming of the LEDs 504. An advantage of this arrangement is that one type of dimmer and dimming signal may be used initially with the combination dimmable driver 500, and thereafter a second, different type of dimmer and dimming signal may be used without having to change out the combination dimmable driver 500.

In some embodiments, the particular dimming level indicator signal generated is designed to cause the dimming controller 516 to control dimming of the LEDs 504 according to a specific dimming profile, such as the ones shown in FIGS. 2A-2C. The specific dimming profile used depends on whether the dimming signal converter 518 received the step dimming signal 508, the phase-cut dimming signal 510, or the 0-10 V dimming signal 512.

Figure 6:
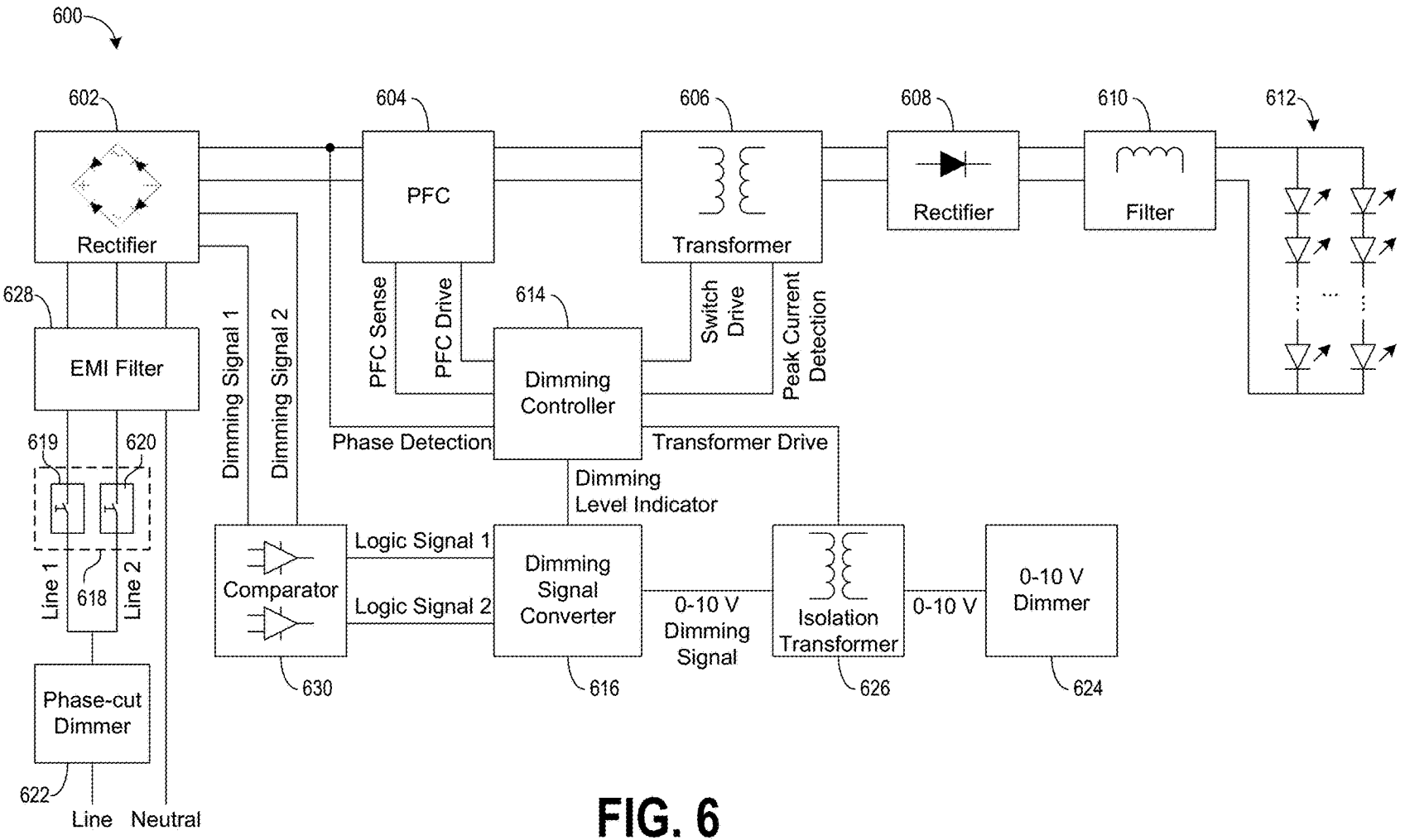
FIG. 6 illustrates an exemplary implementation of the combination dimmable driver according to some implementations of the disclosed embodiments.

FIG. 6 illustrates a more detailed implementation of a combination dimmable driver 600 according to one or more of the embodiments disclosed herein. In this example, the combination dimmable driver 600 may include a bridge rectifier 602, a power factor correction (PFC) module 604, a transformer 606, a full wave rectifier module 608, and a filter module 610, all connected as shown. These modules 602-610 operate in a well-known manner and are therefore only briefly described here. In general, the bridge rectifier 602 rectifies the AC current from a line conductor ("Line") to DC current, the power factor correction module 604 compensates for any phase difference between the current and voltage, and the transformer module 606 steps the rectified DC current down to a level more appropriate for driving LEDs. The stepped down current is subsequently rectified by the full wave rectifier 608 and any harmonics therein may be removed by the filter module 610 to produce a DC current that is suitable for driving the array of LEDs 612. Those having ordinary skill in the art will of course understand that many other arrangements besides the one shown here may be used for providing a suitable DC current to the array of LED 612.

A dimming controller 614 in the combination dimmable driver 600 controls the operation of the power factor correction module 604 and the transformer 606, also in a known manner. Specifically, the dimming controller 614 receives power factor information from the power factor correction module 604 through a PFC current sense signal and provides feedback to the power factor correction module 604 through a PFC drive signal based on the PFC current sense signal. Similarly, the dimming controller 614 receives peak current information from the transformer 606 through a peak current detection signal and controls the switching frequency of the transformer 606 through a switch drive signal based on the peak current detection signal. By controlling (i.e., increasing, decreasing) the switching frequency of the transformer 606, and hence the amplitude of the rectified DC current, the dimming controller 614 is able to adjust the amount of dimming of the LEDs 612.

A dimming signal converter 616 in the combination dimmable driver 600 may be connected to the dimming controller 614 to provide a dimming level indicator signal to the dimming controller 614. The dimming level indicator signal gives the dimming controller 614 an indication of the level to adjust the dimming of the LEDs 612. In accordance with the disclosed embodiments, the particular dimming level indicator signal generated by the dimming signal converter 616 may be based on dimming signals from one or several of the different types of dimmers. In the embodiment shown here, for example, the dimming signal converter 616 may receive (and is compatible with) dimming signals from a step dimmer 618, a phase-cut dimmer 622, and a 0-10 V dimmer 624.

The 0-10 V dimmer 624 may be a conventional 0-10 V dimmer that, when present, may be connected to the dimming signal converter 616 through an isolation transformer 626. Operation (i.e., switching) of the isolation transformer 626 may be controlled by a transformer drive signal provided from the dimming controller 614 to the isolation transformer 626.

The step dimmer 618, when present, may be composed of conventional first and second switches 619, 620 that are connected to Line 1 and Line 2, respectively, from the line conductor. The first and second switches 619, 620 allow Line 1 and Line 2 to be switched on and off independently of each other to adjust dimming of the LEDs 612.

The phase-cut dimmer 622 may likewise be a conventional phase-cut dimmer, either a forward phase-cut dimmer or a reverse phase-cut dimmer. When present, the phase-cut dimmer 622 may be connected to essentially the same wiring as the step dimmer 618, but is positioned before the point where the line conductor splits into Line 1 and Line 2. It is also expected that both the switches 619, 620 will remain closed if they are present when the phase-cut dimmer 622 is connected.

In either case, AC current from Line 1 and/or Line 2 are provided to the bridge rectifier 602, which rectifies the AC current to a DC current. An EMI filter 628 reduces any electromagnetic interference that may be present on Lines 1 and 2 and a neutral ("Neutral") line serves as a return path for current flowing through the LEDs 612.

The bridge rectifier 602 also taps or otherwise draws a small portion of the DC current converted from Lines 1 and 2 to provide two dimming signals, Dimming Signal 1 and Dimming Signal 2. These dimming signals correspond to whether current is flowing through Lines 1 and 2, respectively, meaning that either switch 619 and/or switch 620 are closed. The bridge rectifier 602 then provides these Dimming Signals 1 and 2 to a voltage comparator 630 in the combination dimmable driver 600. The voltage comparator 630 compares the Dimming Signals 1 and 2 to a reference voltage and outputs corresponding logic signals, Logic Signal 1 and Logic Signal 2, to the dimming signal converter 616. If the voltage comparator 630 determines that either Dimming Signals 1 and/or 2 are above the reference voltage, indicating that current is flowing respectively through either Line 1 and/or Line 2, then the comparator asserts Logic Signal 1 and/or Logic Signal 2 accordingly.

In general operation, the dimming signal converter 616 processes dimming signals from whichever dimmer or dimmers are present. Thus, if the 0-10 V dimmer 624 is present, the dimming signal converter 616 generates a dimming level indicator signal based on the 0-10 V dimming signal from the isolation transformer 626 and provides the dimming level indicator signal to the dimming controller 614. The dimming controller 614 thereafter uses the dimming level indicator signal to control dimming as depicted, for example, in FIG. 2C.

If the step dimmer 618 or the phase-cut dimmer 622 is present, then the dimming signal converter 616 processes the dimming signals from the step dimmer 618 or the phase-cut dimmer 622. As discussed above, these dimmers are wired to provide two dimming signals, Dimming Signals 1 and 2, that may be used as first and second Logic Signals 1 and 2, respectively, by the dimming signal converter 616 (via the voltage comparator 630). The dimming signal converter 616 may then generate an appropriate dimming level indicator based on the logic level of these Logic Signals 1 and 2.

With the step dimmer 618, for example, if both Logic Signals 1 and 2 are asserted, then the dimming signal converter 616 generates a minimum dimming level indicator (i.e., little or no dimming). If both Logic Signals 1 and 2 are unasserted, then the dimming signal converter 616 generates a maximum dimming level indicator. If only one of the Logic Signals 1 or 2 is asserted, then the dimming signal converter 616 generates a dimming level indicator that is between the minimum and maximum as depicted, for example, in FIG. 2A.

With the phase-cut dimmer 622, both the first and second dimming signals, Dimming Signals 1 and 2, typically remain logically asserted at all times, so the dimming level indicator generated by the dimming signal converter 616 remains fixed at a minimum level. Dimming is then adjusted (i.e., decreased, increased) by using the phase delays imposed by the phase-cut dimmer 622 on the input from the bridge rectifier 602 as depicted, for example, in FIG. 2B. This phase delay may be detected by the dimming controller 614 through a phase detection signal from the bridge rectifier 602 in a known manner.

An advantage of the latter arrangements is that there is no need for the dimming signal converter 616 to determine whether Dimming Signals 1 and 2 came from the step dimmer 618 or the phase-cut dimmer 622. The dimming signal converter 616 just generates a dimming level indicator signal according to Logic Signals 1 and/or 2 and the desired dimming level simply follows.

In most applications, it is generally expected that only one type of dimmer will be connected at a time to the combination dimmable driver 600. However, in some applications, multiple types of dimmers may be simultaneously connected to the combination dimmable driver 600. When that happens, the combination dimmable driver 600 may add the amount of dimming provided by each type of dimmer on top of the amount of dimming provided by the other types of dimmers according to the exemplary dimming profiles shown FIGS. 2A-2C.

For example, in some applications, the phase-cut dimmer 622 and the 0-10 V dimmer 624 may both be connected to the combination dimmable driver 600 at the same time. In that case, both Logic Signals 1 and 2 are asserted, the dimming signal converter 616 generates a maximum dimming level indicator signal according to the dimming profile in FIG. 2A, and the amount dimming is initially controlled by the phase delay from the phase-cut dimmer 622 according to the dimming profile in FIG. 2B. At about the same time, the dimming signal converter 616 also receives a 0-10 V dimming signal from the 0-10 V dimmer 624 and uses this dimming signal to further adjust the dimming level indicator signal provided to the dimming controller 614. The result is that any dimming provided by the phase-cut dimmer 622 is further dimmed by the 0-10 V dimmer 624 according to the dimming profile in FIG. 2C.

A result similar to the foregoing may be achieved when the step dimmer 618 and the 0-10 V dimmer 624 are simultaneously connected to the combination dimmable driver 600, or when all three types of dimmers are simultaneously connected to the combination dimmable driver 600.

In some embodiments, it is also possible to configure the combination dimmable driver 600 so that the dimming signal converter 616 automatically prioritizes or otherwise defaults to a particular type of dimmer if that dimmer is present. For example, the combination dimmable driver 600 may be programmed so that the dimming signal converter 616 automatically checks first to see whether the 0-10 V dimmer 624 is present. If the 0-10 V dimmer 624 is not present, then dimming signal converter 616 checks for the step dimmer 618 and/or the phase cut dimmer 622. Alternatively, the combination dimmable driver 600 may be programmed so that the dimming signal converter 616 automatically checks first to see whether the step dimmer 618 and/or the phase cut dimmer 622 are present before checking for the 0-10 V dimmer 624.

In some embodiments, the combination dimmable driver 600 may be programmed so that the dimming signal converter 616 automatically selects certain predefined defaults or programmed dimming levels when dimming signals from multiple types of dimmers are received at the same time. For example, if the combination dimmable driver 600 receives a dimming signal from both the 0-10 V dimmer 624 and the phase-cut dimmer 622, the dimming signal converter 616 may generate a dimming level indicator that reflects a specified default dimming scheme, such as a percentage of the dimming signals from both (or each) dimmer. In these embodiments, one or more tables may be used to specify the particular dimming level indicator to be generated by the dimming signal converter 616. An exemplary table is shown in Table 1 below. Of course, alternative default dimming behavior and/or number of dimmer types may be derived by those having ordinary skill in the art without departing from the scope of the disclosed embodiments.

TABLE 1

| Dimmer Type 1 | Dimmer Type 2 | Dimmer Type 3 | Default Dimming Scheme |
|---|---|---|---|
| X | — | — | A |
| — | X | — | B |
| — | — | X | C |
| X | X | — | D |
| — | X | X | E |
| X | — | X | F |
| X | X | X | G |

Figure 7:
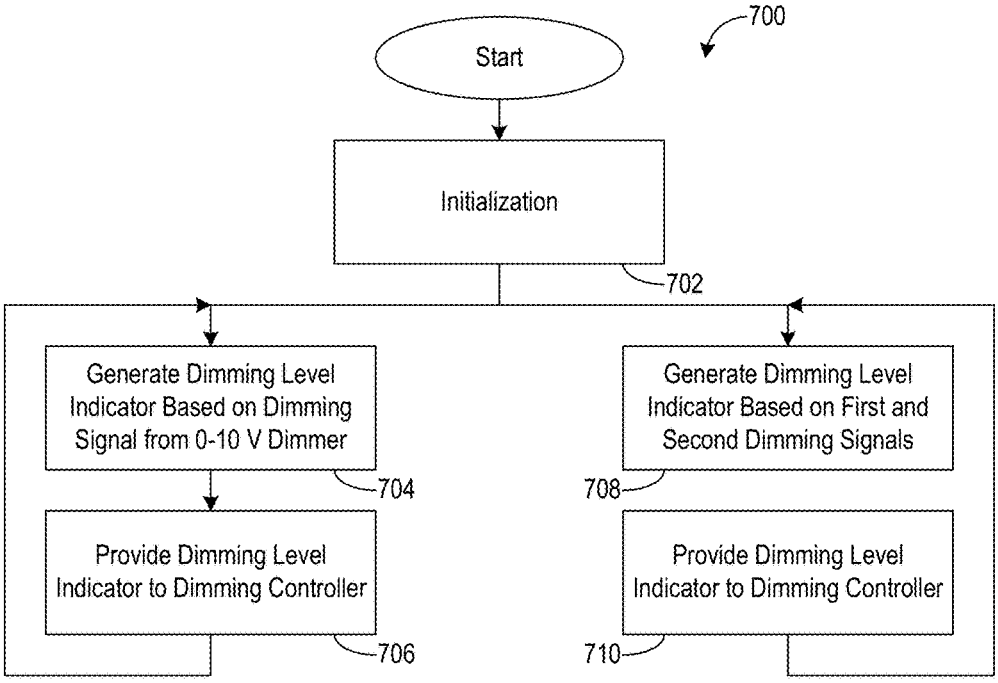
FIG. 7 illustrates an exemplary method that may be used by the combination dimmable driver according to some implementations of the disclosed embodiments.

Thus far, a number of specific implementations of a combination dimmable driver have been described. Following now in FIG. 7 are general guidelines in the form of a flow chart 700 reflecting a method that may be used to implement the combination dimmable driver. Those having ordinary skill in the art will understand, of course, that alternative arrangements may be derived from the teachings herein without departing from the scope of the disclosed embodiments.

The flow chart 700 generally begins with an initialization phase at block 702 where various components of the combination dimmable driver may be set and/or reset as needed. At block 704, if a 0-10 V dimming signal is present, the combination dimmable driver generates a dimming level indicator signal based on the 0-10 V dimming signal. The combination dimmable driver thereafter provides the dimming level indicator signal to the dimming controller at block 706. At about the same time or in parallel, if a first and/or second dimming signals are present, the combination dimmable driver generates a dimming level indicator signal based on the first and second dimming signals at block 708. The combination dimmable driver thereafter provides the dimming level indicator signal to the dimming controller at block 710.

Figure 8:
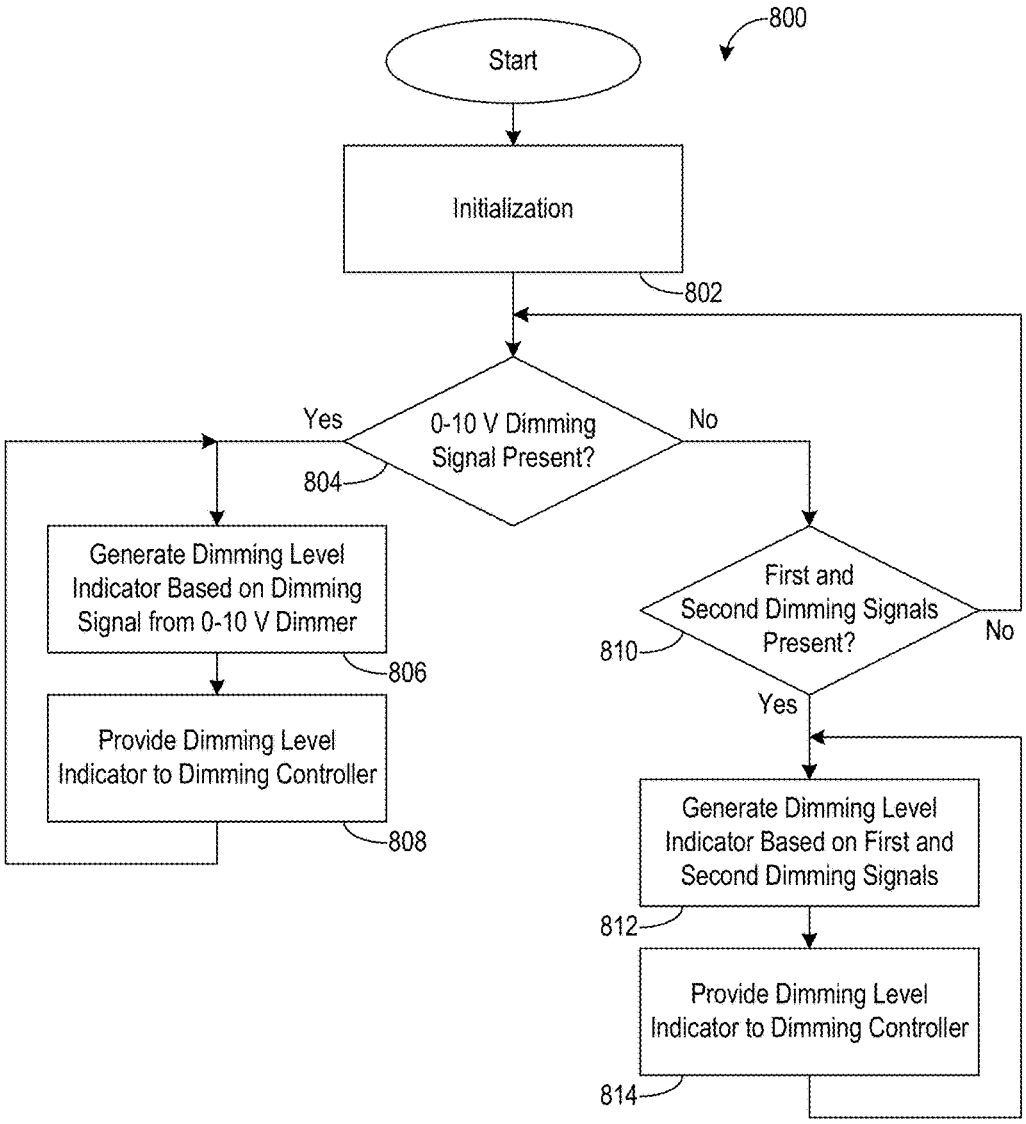
FIG. 8 illustrates another exemplary method that may be used by the combination dimmable driver according to some implementations of the disclosed embodiments.

FIG. 8 illustrates a flow chart 800 reflecting an alternative method in which the combination dimmable driver has been set to prioritize or default to a particular type of dimmer. In this example, the combination dimmable driver has been programmed to check first for the presence of a 0-10 V dimmer before checking for other types of dimmers.

The flow chart 800 generally begins with an initialization phase at block 802 where various components of the combination dimmable driver may be set and/or reset as needed. At block 804, the combination dimmable driver determines whether a 0-10 V dimming signal, indicating that a 0-10 V dimmer may be present or otherwise connected. If the determination is yes, then the combination dimmable driver proceeds to generate a dimming level indicator based on the 0-10 V dimming signal at block 806. The combination dimmable driver thereafter provides the dimming level indicator to a dimming controller at block 808.

If the determination at block 804 is no, then the combination dimmable driver determines at block 810 whether the first and second dimming signals are present, as may be the case if a step dimmer and/or a phase-cut dimmer is connected. If the determination is yes, then the combination dimmable driver proceeds to generate a dimming level indicator based on the first and second dimming signals at block 812 and provide the indicator to the dimming controller at block 814. If the determination is no, then the combination dimmable driver returns to block 804 to check for the presence the 0-10 V dimmer.

It should be noted that while a 0-10 V dimmer has been used as the default dimmer in the foregoing embodiment, the decision on which type of dimmer is used as the default dimmer, whether the 0-10 V dimmer, a step dimmer, or a phase-cut dimmer, can vary and may be chosen as needed for a particular application.

Figure 9:
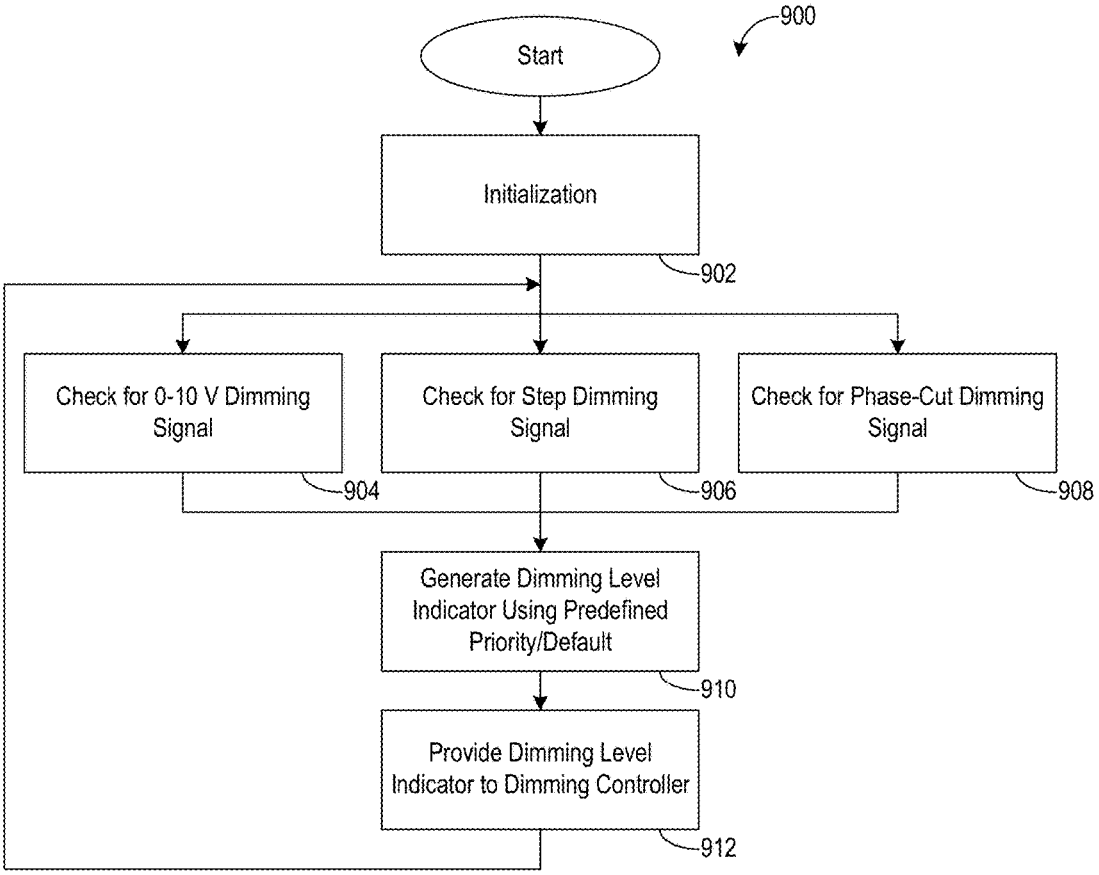
FIG. 9 illustrates yet another exemplary method that may be used by the combination dimmable driver according to some implementations of the disclosed embodiments.

FIG. 9 illustrates a flow chart 900 reflecting another alternative method in which the combination dimmable driver has been programmed to use dimming signals from multiple types of dimmers at the same time (or nearly the same time) if they are present. In these embodiments, the dimming signal converter may generate the dimming level indicator based on whichever dimming signals are present using either a predefined priority that specifies the order in which the dimming signals are applied or a set of predefined defaults that specify particular levels of dimming. As in previous embodiments, the flow chart 900 generally begins with an initialization phase at block 902 where various components of the combination dimmable driver may be set and/or reset as needed. At block 904, the combination dimmable driver may check for a 0-10 V dimming signal, while at block 906, the combination dimmable driver may check for a step dimming signal, and at block 908, the combination dimmable driver may check for a phase-cut dimming signal.

The combination dimmable driver may then generate a dimming level indicator signal at block 910 based on all or some of the dimming signals present using a predefined priority or a set of predefined defaults as explained above. For example, the combination dimmable driver may use the dimming signal from the phase-cut dimmer first, then the step dimmer, and then the 0-10 V dimmer, or vice versa, or some other sequence to generate the dimming level indicator. Or the combination dimmable driver may generate the dimming level indicators using a table similar to Table 1 in some embodiments. Alternatively, the combination dimmable driver may generate the dimming level indicator based on any two dimming signals using a predefined priority, such as the 0-10 V dimmer then the phase-cut dimmer, or the 0-10 V dimmer then the step dimmer, or the phase-cut dimmer then the step dimmer, and so forth, or vice versa. The combination dimmable driver may also generate the dimming level indicator based on only one dimming signal, whether the 0-10 V dimmer, the phase-cut dimmer, or the step dimmer, using a predefined priority.

The combination dimmable driver thereafter provides the dimming level indicator to a dimming controller at block 912 and the method 900 returns to blocks 904, block 906, and/or block 908 to continue checking for dimming signals from the different types of dimmers.

While particular aspects, implementations, and applications of the present disclosure have been illustrated and described, it is to be understood that the present disclosure is not limited to the precise construction and compositions disclosed herein and that various modifications, changes, and variations may be apparent from the foregoing descriptions without departing from the spirit and scope of the disclosed embodiments as defined in the appended claims.

What is claimed is:

1. A combination dimmable driver for a light fixture, comprising:

an AC/DC power converter connected to the light fixture and configured to provide power to a plurality of LEDs in the light fixture;

a dimming controller connected to the AC/DC power converter, the dimming controller configured to control a level of dimming for the plurality of LEDs in the light fixture; and a dimming signal converter connected to the dimming controller and configured to provide a dimming level indicator to the dimming controller, the dimming controller controlling the level of dimming for the plurality of LEDs based on the dimming level indicator;

wherein the dimming signal converter is further configured to receive dimming signals from multiple types of dimmers and generate the dimming level indicator based on a dimming signal received from one of the multiple types of dimmers.

2. The combination dimmable driver of claim 1, wherein the multiple types of dimmers include a 0-10 V dimmer and the dimming signal converter is configured to generate the dimming level indicator based on a dimming signal from the 0-10 V dimmer.

3. The combination dimmable driver of claim 1, wherein the multiple types of dimmers include a step dimmer and the dimming signal converter is configured to generate the dimming level indicator based on a dimming signal from the step dimmer.

4. The combination dimmable driver of claim 3, wherein the step dimmer provides a first dimming signal and a second dimming signal and the dimming signal converter is configured to generate the dimming level indicator based on a logic level of each dimming signal from the step dimmer.

5. The combination dimmable driver of claim 4, further comprising a comparator connected to the dimming signal converter and configured to determine the logic level of each dimming signal from the step dimmer.

6. The combination dimmable driver of claim 1, wherein the multiple types of dimmers include a phase-cut dimmer and the dimming signal converter is configured to generate the dimming level indicator based on dimming signals from the phase-cut dimmer.

7. The combination dimmable driver of claim 6, wherein the dimming level indicator generated by the dimming signal converter stays at a minimum level and the dimming controller uses a phase delay generated by the phase-cut dimmer to adjust the level of dimming for the plurality of LEDs in the light fixture.

8. The combination dimmable driver of claim 1, wherein the dimming signal converter receives dimming signals from the multiple types of dimmers at the same time and generates the dimming level indicator based on a dimming signal from at least one of the multiple types of dimmers using a predefined priority or a predefined set of defaults for the multiple types of dimmers.

9. A method of dimming a plurality of LEDs in a light fixture, comprising:

receiving dimming signals from multiple types of dimmers at the same time;

generating a dimming level indicator based on the dimming signals from the multiple types of dimmers using a predefined set of defaults or predefined dimming levels; and controlling a level of dimming for the plurality of LEDs in the light fixture based on the dimming level indicator.

10. The method of claim 9, wherein the dimming level indicator is based on the dimming signal from a first one of the multiple types of dimmers, further comprising:

receiving a second dimming signal from a second one of the multiple types of dimmers that is different from the first one of the multiple types of dimmers;

generating a second dimming level indicator based on the dimming signal from the second one of the multiple types of dimmers; and controlling the level of dimming for the plurality of LEDs in the light fixture based on the second dimming level indicator.

11. The method of claim 9, wherein the multiple types of dimmers include a 0-10 V dimmer and the dimming level indicator is generated based on a dimming signal from the 0-10 V dimmer.

12. The method of claim 9, wherein the multiple types of dimmers include a step dimmer and the dimming level indicator is generated based on a dimming signal from the step dimmer.

13. The method of claim 12, wherein the step dimmer provides a first dimming signal and a second dimming signal and the dimming level indicator is generated based on a logic level of each dimming signal from the step dimmer.

14. The method of claim 13, further comprising comparing the first and second dimming signals from the step dimmer to determine the logic level of each dimming signal.

15. The method of claim 9, wherein the multiple types of dimmers include a phase-cut dimmer and the dimming level indicator is generated based on dimming signals from the phase-cut dimmer.

16. The method of claim 15, wherein the dimming level indicator generated based on the dimming signals from the phase-cut dimmer stays at a minimum level further comprising using a phase delay generated by the phase-cut dimmer to adjust the level of dimming for the plurality of LEDs in the light fixture.

17. A light fixture, comprising:

a plurality of LEDs; and a dimmable driver connected to the plurality of LEDs, the dimmable driver compatible with three or more types of dimmers and configured to control dimming of the plurality of LEDs based on a dimming signal from at least one of said types of dimmers, wherein the dimmable driver receives dimming signals from at least two of the three or more types of dimmers at the same time and generates a dimming level indicator based the dimming signals received from the at least two types of dimmers using a predefined set of defaults or predefined dimming levels.

18. The light fixture of claim 17, wherein the types of dimmers include a step dimmer, a phase-cut dimmer, and a 0-10 V dimmer.

19. The light fixture of claim 18, wherein the dimmable driver is connected to the step dimmer and the 0-10 V dimmer at the same time.

20. The light fixture of claim 18, wherein the dimmable driver is connected to the step dimmer, the phase-cut dimmer, and the 0-10 V dimmer at the same time.

21. The light fixture of claim 17, wherein the dimmable driver is configured to operate with a preset one of the types of dimmers if the preset one of the types of dimmers is connected to the dimmable driver.

* * * * *